US008618703B2

(12) United States Patent
Kinoshita et al.

(10) Patent No.: US 8,618,703 B2
(45) Date of Patent: Dec. 31, 2013

(54) MOTOR DRIVEN COMPRESSOR

(75) Inventors: Yusuke Kinoshita, Aichi-ken (JP); Shingo Enami, Aichi-ken (JP); Ken Suitou, Aichi-ken (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 339 days.

(21) Appl. No.: 13/005,825

(22) Filed: Jan. 13, 2011

(65) Prior Publication Data

US 2011/0175470 A1 Jul. 21, 2011

(30) Foreign Application Priority Data

Jan. 18, 2010 (JP) ..... 2010-008406

(51) Int. Cl.
*H02K 5/22* (2006.01)

(52) U.S. Cl.
USPC ..... 310/71

(58) Field of Classification Search
USPC ..... 310/71
See application file for complete search history.

(56) References Cited

U.S. PATENT DOCUMENTS

| | | | | |
|---|---|---|---|---|
| 6,599,104 | B2 | 7/2003 | Saito et al. | |
| 7,083,399 | B2 * | 8/2006 | Kurihara et al. | 417/423.7 |
| 7,290,989 | B2 * | 11/2007 | Jayanth | 417/44.1 |
| 2002/0025265 | A1 * | 2/2002 | Ikeda | 417/410.1 |
| 2002/0062655 | A1 | 5/2002 | Bellet | |
| 2007/0237650 | A1 | 10/2007 | Birkenstock et al. | |
| 2009/0104055 | A1 | 4/2009 | Satou et al. | |

FOREIGN PATENT DOCUMENTS

| | | | |
|---|---|---|---|
| CN | 2468212 | Y | 12/2001 |
| CN | 101155994 | A | 4/2008 |
| CN | 101191476 | A | 6/2008 |
| JP | 2004-190547 | A | 7/2004 |
| JP | 4144465 | A | 2/2005 |
| JP | 2009-74517 | A | 4/2009 |

OTHER PUBLICATIONS

German Office Action for corresponding DE Patent Application No. 10 2011 000 179.4 issued on Sep. 14, 2012.

* cited by examiner

*Primary Examiner* — Burton Mullins
*Assistant Examiner* — Eric Johnson
(74) *Attorney, Agent, or Firm* — Sughrue Mion, PLLC

(57) ABSTRACT

A motor-driven compressor includes a housing having at one end thereof an accommodation space, an electric motor, a motor driver circuit provided in the accommodation space and having a circuit board, a connector having a bus bar electrically connected to the circuit board, and a cylindrical portion located at the one end of the housing and extending toward the direction close to the electric motor. The housing has a mounting hole communicating with the accommodation space and the interior of the cylindrical portion. The bus bar has a bent shape having opposite ends extended toward the direction close to the electric motor. The connector is disposed in the mounting hole with one end of the bus bar inserted in the cylindrical portion and the other end of the bus bar inserted in the accommodation space. The mounting hole is closed up by a cover with a seal member provided therebetween.

10 Claims, 5 Drawing Sheets

MOTOR DRIVEN COMPRESSOR

BACKGROUND OF THE INVENTION

The present invention relates to a motor-driven compressor having a compression mechanism, an electric motor and a motor driver circuit arranged in axial direction of a rotary shaft of the compressor.

There is known a motor-driven compressor having a compression mechanism, an electric motor and a motor driver circuit arranged in a housing in axial direction of a rotary shaft of the compressor. The motor driver circuit includes an inverter having a planar circuit board on which electronic components such as a switching device are mounted. The housing has on the outer surface thereof a cylindrical connector holder projecting outward at a position adjacent to the inverter. A connector having a bus bar electrically connected to the circuit board and an insulator holding the bus bar is provided in the connector holder.

When the connector holder extends from the housing in a direction perpendicular to the axial direction of the rotary shaft (hereinafter referred to as radial direction of the housing), the entire size of the compressor is increased in the radial direction. When the connector holder extends outward from the housing in radial direction at a position adjacent to the inverter and then along the axis of the rotary shaft in the direction away from the electric motor, the entire size of the compressor is increased in the axial direction of the rotary shaft. To prevent an increase of the entire size of the compressor as much as possible, for example, Japanese Unexamined Patent Application Publication No. 2009-74517 discloses a motor-driven compressor in which the connector holder extends radially outward from the housing at a position adjacent to the inverter and then extends along the axis of the rotary shaft toward the direction close to the electric motor.

In the arrangement of the compressor disclosed in the publication No. 2009-74517, the connector is provided in the axially extending cylindrical portion of the connector holder and the bus bar is also provided in the same portion of the connector holder. To connect the bus bar to the circuit board, part of the circuit board needs to be extended beyond the outer peripheral surface of the housing into the cylindrical portion, resulting in an increased size of the circuit board.

When the circuit board extends beyond the outer peripheral surface of the housing into cylindrical portion, the housing needs to have a large mounting hole for connection of such large circuit board to the bus bar and, therefore, a large cover for closing such large mounting hole needs to be provided. This results in an increased sealing area of the seal member for sealing between the cover and the housing.

The present invention is directed to providing a motor-driven compressor that allows a reduced sealing area of a seal member and a reduced size of a circuit board in the structure having a cylindrical portion extending toward the direction close to an electric motor.

SUMMARY OF THE INVENTION

In accordance with an aspect of the present invention, a motor-driven compressor includes a housing having at one end thereof an accommodation space, a rotary shaft extending in the housing, a compression mechanism driven by the rotary shaft, an electric motor rotating the rotary shaft, a motor driver circuit provided in the accommodation space and having a circuit board, a connector having a bus bar electrically connected to the circuit board, and a cylindrical portion located at the one end of the housing and extending toward the direction close to the electric motor. The compression mechanism, the electric motor and the motor driver circuit are arranged in the housing in axial direction of the rotary shaft. The housing has a mounting hole communicating with the accommodation space and the interior of the cylindrical portion. The bus bar has a bent shape having opposite ends extended toward the direction close to the electric motor. The connector is disposed in the mounting hole with one end of the bus bar inserted in the cylindrical portion and the other end of the bus bar inserted in the accommodation space. The mounting hole is closed up by a cover with a seal member provided therebetween.

Other aspects and advantages of the invention will become apparent from the following description, taken in conjunction with the accompanying drawings, illustrating by way of example the principles of the invention.

DETAILED DESCRIPTION OF THE EMBODIMENTS

Figure 1:
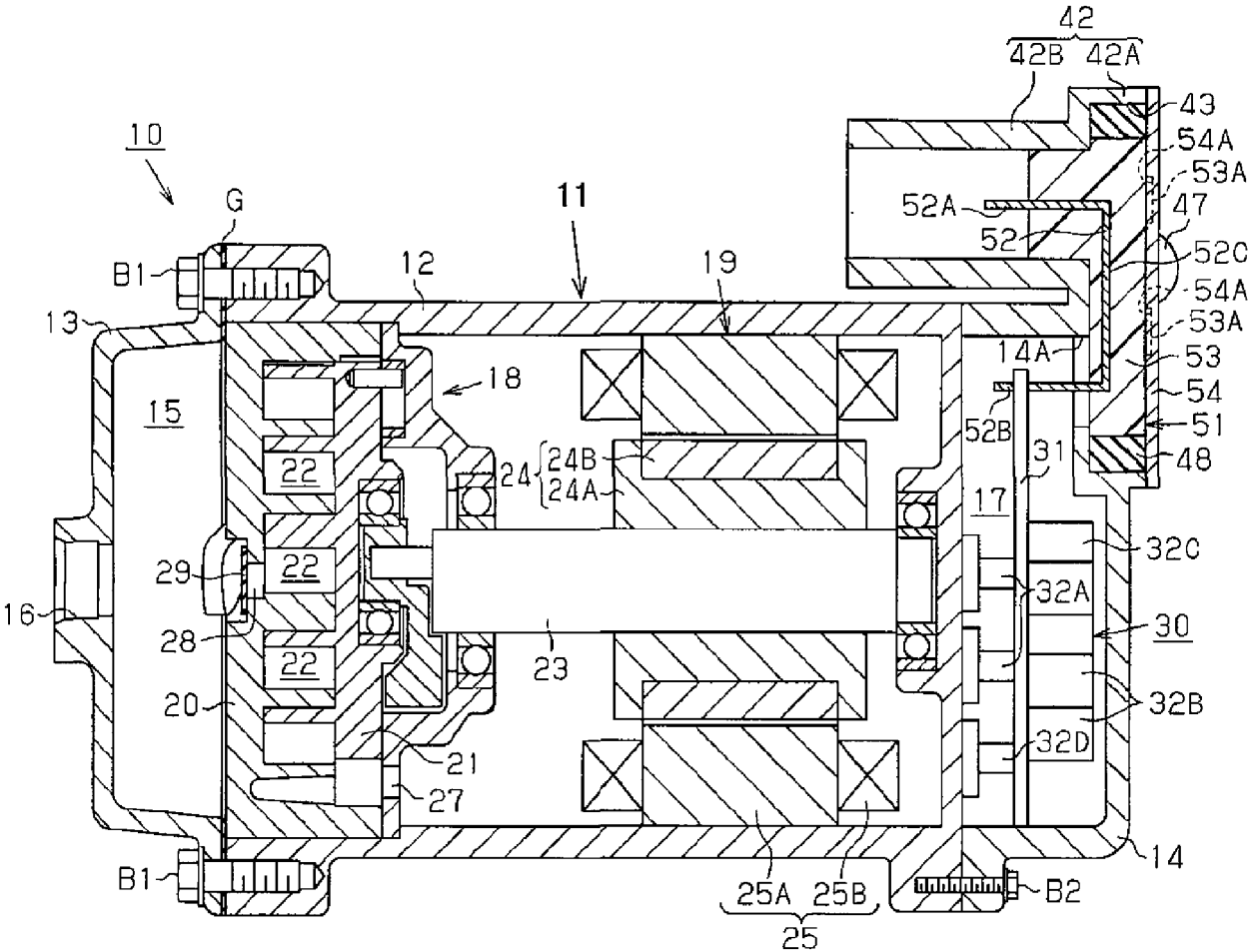
FIG. 1 is a longitudinal sectional view of a motor-driven compressor according to a first embodiment of the present invention.
Figure 2:
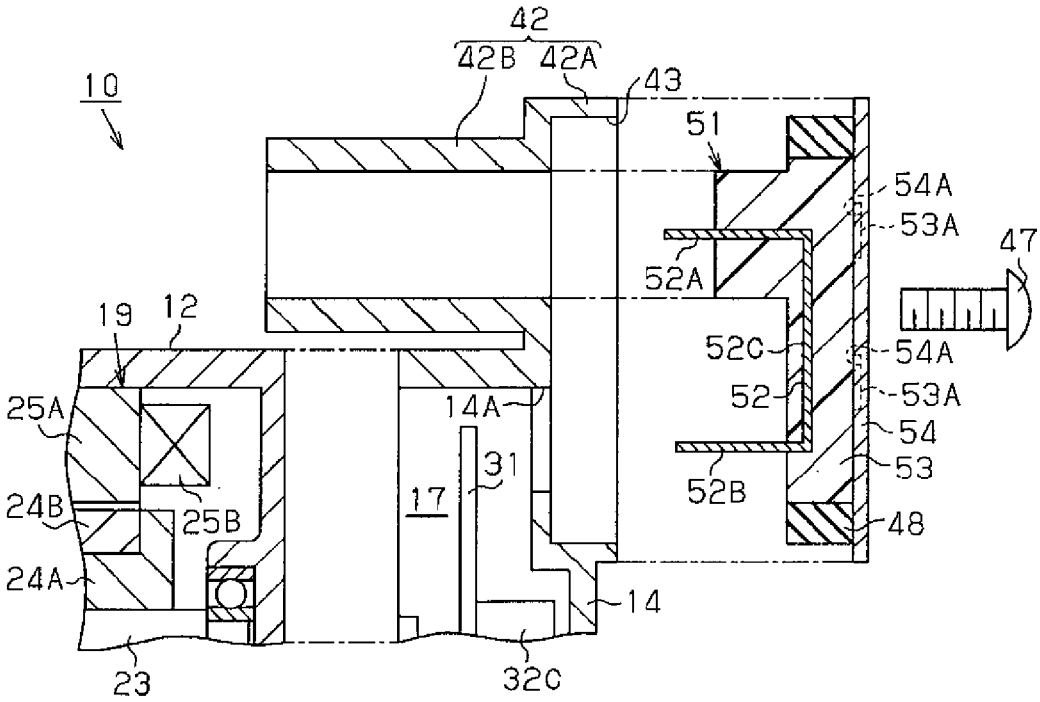
FIG. 2 is a fragmentary sectional view of the compressor of FIG. 1, showing an inverter housing and a connector of the compressor before assembly.
Figure 3:
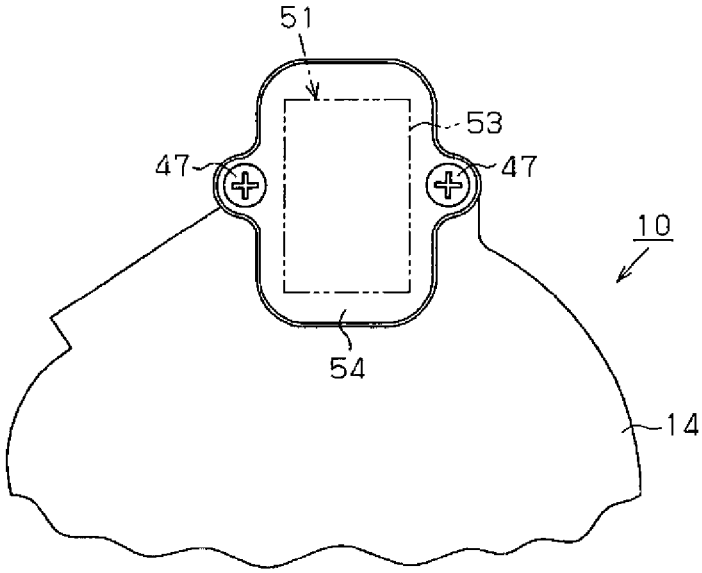
FIG. 3 is a rear elevational view of the compressor of FIG. 1, showing a cover mounted to the inverter housing.

The following will describe the first embodiment of the motor-driven compressor according to the present invention with reference to FIGS. 1 through 3. The compressor is intended for use in an air conditioner for a hybrid electric vehicle. It is noted that the left-hand side and the right-hand side as viewed in FIG. 1 are the front side and the rear side of the compressor, respectively. Referring to FIG. 1, the compressor 10 has a housing assembly (hereinafter referred to as housing) 11 made of an electrically conductive material such as aluminum. The housing 11 includes an intermediate housing 12, a discharge housing 13 and an inverter housing 14. The intermediate housing 12 is of a cylindrical shape having an open end and a closed end on the front and the rear sides thereof, respectively. The discharge housing 13 is fastened to the open end of the intermediate housing 12 through a gasket G by bolts B1, and the inverter housing 14 is fastened to the closed end of the intermediate housing 12 by bolts B2. The intermediate housing 12 and the inverter housing 14 form therebetween an accommodation space 17.

The intermediate housing 12 and the discharge housing 13 form therebetween a discharge chamber 15. The discharge housing 13 has at the front end thereof an outlet port 16 through which the discharge chamber 15 is connected to an external refrigerant circuit (not shown in the drawing). The intermediate housing 12 is connected to the external refrigerant circuit through an inlet port (not shown) formed through the intermediate housing 12 at a position adjacent to the inverter housing 14.

The compressor 10 has a rotary shaft 23 rotatably supported in the intermediate housing 12. The intermediate housing 12 receives therein a compression mechanism 18 for compressing refrigerant and an electric motor 19 for driving the compression mechanism 18. The accommodation space 17 accommodates therein an inverter 30 for controlling the operation of the electric motor 19. The compression mechanism 18, the electric motor 19 and the inverter 30 are arranged in this order in the housing 11 in axial direction of the rotary shaft 23.

The compression mechanism 18 includes a fixed scroll 20 and a movable scroll 21. The fixed scroll 20 is fixedly mounted on the intermediate housing 12. The movable scroll 21 is disposed so as to face the fixed scroll 20 and to form compression chambers 22 therebetween. The volume of each compression chamber 22 is variable. The fixed scroll 20 is formed with a discharge passage 28 through which the compression chamber 22 communicates with the discharge chamber 15. The fixed scroll 20 has at the front end thereof a discharge valve 29.

The electric motor 19 includes a rotor 24 and a stator 25. The rotor 24 is mounted on the rotary shaft 23 for rotation therewith. The rotor 24 has a rotor core 24A secured to the rotary shaft 23 and permanent magnets 24B mounted on the periphery of the rotor core 24A. The stator 25 is of a cylindrical shape and has a stator core 25A mounted on the inner peripheral surface of the intermediate housing 12 and a coil 25B wound on the teeth (not shown in the drawing) of the stator core 25A.

The inverter 30 (motor driver circuit) in the accommodation space 17 includes a planar circuit board 31 and various kind of electronic components 32A, 32B, 32C and 32D mounted on the circuit board 31. The circuit board 31 is mounted on the inner surface of the inverter housing 14, extending in radial direction of the rotary shaft 23. The inverter 30 supplies electric power to the stator 25 of the electric motor 19 under the control of an air conditioner controller (not shown in the drawing).

In the above-described compressor 10, when electric power is supplied from the inverter 30 to the electric motor 19, the rotor 24 is rotated with the rotary shaft 23 thereby to drive the compression mechanism 18. While the compression mechanism 18 is in operation, the volume of each compression chamber 22 between the fixed and the movable scrolls 20 and 21 is varied, and refrigerant gas is introduced from the external refrigerant circuit through the inlet port into the interior of the intermediate housing 12. The refrigerant gas then flows through a suction passage 27 into the compression chambers 22 and is compressed therein. The compressed refrigerant gas is discharged via the discharge passage 28 into the discharge chamber 15 while pushing open the discharge valve 29, and flows out of the compressor 10 through the outlet port 16 into the external refrigerant circuit. The refrigerant then flows through the external refrigerant circuit and back into the interior of the intermediate housing 12.

The inverter housing 14 is provided on the outer surface thereof with a connector holder 42. The connector holder 42 includes an extension portion 42A and a cylindrical portion 42B. The extension portion 42A extends outward in radial direction of the rotary shaft 23 from the outer peripheral surface of the inverter housing 14 at a position adjacent to the end wall. The extension portion 42A is formed over part of the end wall of the inverter housing 14. The cylindrical portion 42B extends in axial direction of the rotary shaft 23 from the extension portion 42A toward the direction close to the electric motor 19. The connector holder 42 is formed integrally with the inverter housing 14.

The housing 11 has at one end thereof a mounting hole 43 formed over the extension portion 42A of the connector holder 42 and part of the end wall of the inverter housing 14. The mounting hole 43 is opened on the end wall of the inverter housing 14. The mounting hole 43 communicates with the interior of the extension portion 42A and the cylindrical portion 42B and also with the accommodation space 17 through a through hole 14A formed in the end wall of the inverter housing 14 at a position adjacent to the connector holder 42. The mounting hole 43 communicates with the interior of the connector holder 42 and the accommodation space 17 and allows the interior of the connector holder 42 and part of the circuit board 31 in the accommodation space 17 to be exposed to the outside of the inverter housing 14 or the housing 11 (see FIG. 2). Although most part of the accommodation space 17 is closed by the end wall of the inverter housing 14, the part of the inverter housing 14 of the accommodation space 17 facing the through hole 14A is exposed to the outside of the inverter housing 14. The inverter housing 14 has the through hole 14A between the accommodation space 17 and the mounting hole 43. The cross-sectional area of the through hole 14A is smaller than the area of the circuit board 31.

The compressor 10 has a connector 51 inserted in the mounting hole 43. Referring to FIG. 2, the connector 51 has a bus bar 52 to be connected electrically to the circuit board 31 and an insulator 53 holding the bus bar 52 in place. The bus bar 52 is formed by bending a metal wire into U-shape. The bus bar 52 has two opposite ends 52A and 52B extending parallel to each other and connected together by a connecting portion 52C extending perpendicular to the ends 52A and 52B. In the bus bar 52, the ends 52A and 52B both extend in the same direction toward the direction close to the electric motor 19. The bus bar 52 is held by the insulator 53 with the connecting portion 52C embedded in the insulator 53 and the opposite ends 52A and 52B projecting from one end surface of the insulator 53. The insulator 53 has in the other end surface thereof two projections 53A.

The insulator 53 is connected at the other end surface thereof to a cover 54 for closing the mounting hole 43. The cover 54 is of a planar shape and made of an electrically, conductive material, for example, a metal such as aluminum. The cover 54 has in one end surface thereof two recesses 54A for receiving therein the projections 53A of the insulator 53, thus allowing the cover 54 to be integrated with the insulator 53. With the projections 53A fitted in the recesses 54A, the periphery of the cover 54 is located radially outward of the insulator 53. There is further provided a grommet 48 (seal member) around the insulator 53. In the present embodiment, the cover 54 and the grommet 48 are previously integrated with the connector 51 including the bus bar 52 and the insulator 53.

The following will describe a procedure for connecting the bus bar 52 to the circuit board 31. It is noted that the circuit board 31 has already been mounted on the inner surface of the inverter housing 14 and that the inverter housing 14 is yet to be connected to the intermediate housing 12.

Firstly, as shown in FIG. 2, with the grommet 48 mounted on the outer periphery of the insulator 53, the connector 51 is inserted into the mounting hole 43 so that the one end 52A of the bus bar 52 is inserted into the extension portion 42A of the connector holder 42 and the other end 52B of the bus bar 52 is inserted into the through hole 14A. By so doing, the one end 52A of the bus bar 52 is inserted in and surrounded by the cylindrical portion 42B of the connector holder 42. The other end 52B of the bus bar 52 is inserted in the accommodation space 17 and inserted through the circuit board 31. The cover 54 closes the mounting hole 43, and the grommet 48 seals between the cover 54 and the periphery of the mounting hole 43.

Next, the other end 52B of the bus bar 52 is soldered to the circuit board 31 through the opening of the inverter housing 14 on the side of the electric motor 19 so that the bus bar 52 is electrically connected to the circuit board 31. Then the cover 54 is fastened to the inverter housing 14 using bolts 47 (see FIG. 3). In this way, the cover 54 is mounted to the inverter housing 14, and simultaneously the connector 51 is mounted to the connector holder 42.

The motor-driven compressor 10 according to the first embodiment offers the following advantages.

(1) The interior of the connector holder 42 communicates with the accommodation space 17 through the mounting hole 43 formed at one end of the inverter housing 14. The bus bar 52 is bent into a U-shape with the ends 52A and 52B both directed toward the direction close to the electric motor 19. When the connector 51 is inserted into the mounting hole 43, the one end 52A of the bus bar 52 is inserted into the connector holder 42 and, simultaneously, the other end 52B of the bus bar 52 is inserted into the accommodation space 17 for connection to the circuit board 31. This allows the circuit board 31 to be located within the accommodation space 17, that is, within the inverter housing 14, which results in a reduced size of the circuit board 31, as compared to the case where part of the circuit board extends beyond the outer peripheral surface of the inverter housing. Further, with the cover 54 not mounted to the inverter housing 14 and the mounting hole 43 not closed by the cover 54, the mounting hole 43 needs not have such a size that allows the whole of the circuit board 31 in the accommodation space 17 to face the outside of the inverter housing 14. The mounting hole 43 may only have to have such a size that allows only part of the circuit board 31 in the accommodation space 17 and the interior of the connector holder 42 to face the outside of the inverter housing 14. This allows reduction of the size of the mounting hole 43 thereby to allow reduction of the size of the cover 54 closing the mounting hole 43 and also the size of the grommet 48 provided between the mounting hole 43 and the cover 54, resulting in a reduced sealing area of the grommet 48.

(2) There is a case where the cylindrical portion of the connector holder is formed by a separate member inserted in a hole formed through the extension portion extending radially outward from the outer peripheral surface of the housing. Although in this case it is necessary to provide a seal member for sealing between the hole and the separate member, the present embodiment wherein the extension portion 42A and the cylindrical portion 42B of the connector holder 42 are formed integrally with the inverter housing 14 requires no such seal member, resulting in a reduced number of parts of the compressor.

(3) The insulator 53 of the connector 51 has the projections 53A fitted in the recesses 54A of the cover 54, which allows the insulator 53 to be integrated with the cover 54. Fastening the cover 54 to the inverter housing 14 using the bolts 47, the cover 54 is mounted to the inverter housing 14 and, simultaneously, the connector 51 is mounted to the connector holder 42.

(4) Since the cover 54 is made of an electrically conductive material such as aluminum, the cover 54 is coupled to the inverter housing 14 not only mechanically but also electrically. Any electrical noise flowing through the cover 54 is prevented from flowing through the bus bar 52 and the circuit board 31, but delivered to the inverter housing 14.

The above embodiment may be modified in various ways as exemplified below.

Figure 4:
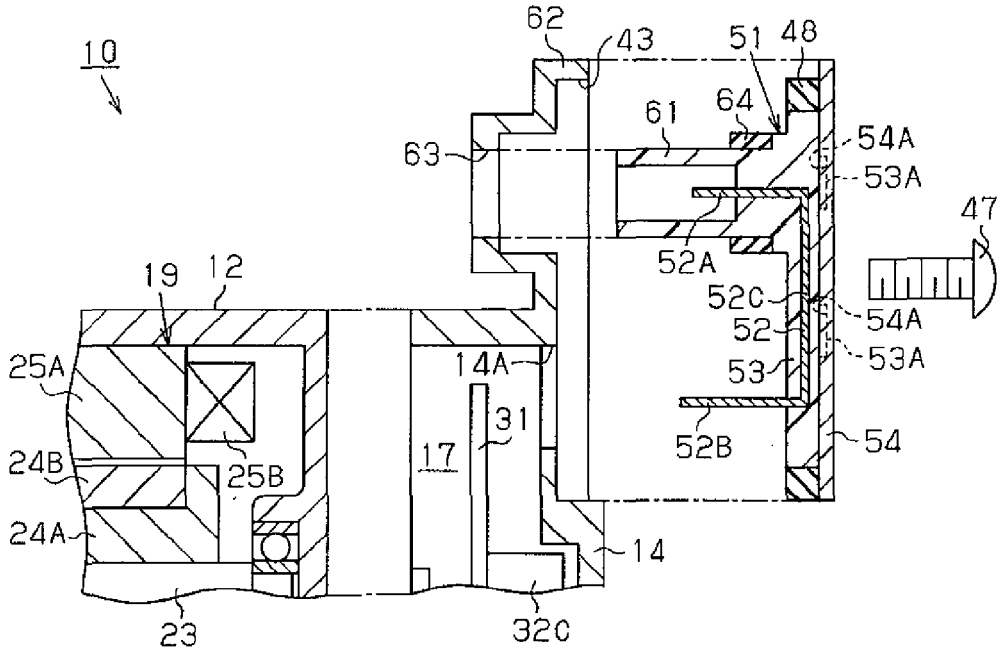
FIG. 4 is a sectional view showing the inverter housing and the connector before assembly according to another embodiment.
Figure 5:
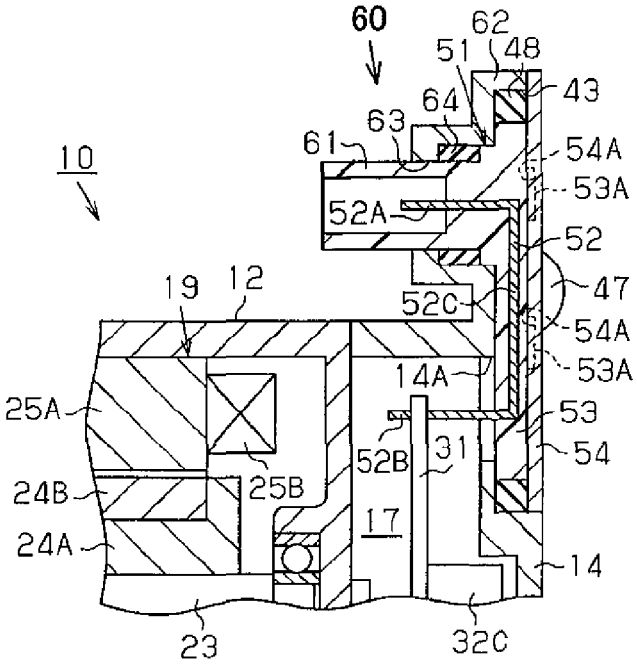
FIG. 5 is a sectional view showing the inverter housing and the connector of FIG. 4 after assembly.

Although in the first embodiment the extension portion 42A and the cylindrical portion 42B of the connector holder 42 are formed integrally with the inverter housing 14, the cylindrical portion may be formed separately from the inverter housing. Referring to FIG. 4, part of the insulator 53 is formed in a cylindrical shape surrounding the one end 52A of the bus bar 52 in the connector 51 to form a cylindrical portion 61. The inverter housing 14 has on the outer periphery thereof an extension portion 62 as in the first embodiment. The extension portion 62 is formed therethrough with a connector hole 63. When the connector 51 is inserted into the mounting hole 43 so that the cylindrical portion 61 is inserted through the connector hole 63 of the extension portion 62, the cylindrical portion 61 projects out from the extension portion 62 toward the direction close to the electric motor 19, as shown in FIG. 5. The extension portion 62 cooperates with the cylindrical portion 61 to form a connector holder 60. In this way, the cylindrical portion 61 of the connector holder 60 may be provided separately from the inverter housing 14, in which case a seal member 64 needs to be provided for sealing between the cylindrical portion 61 and the connector hole 63.

Figure 6:
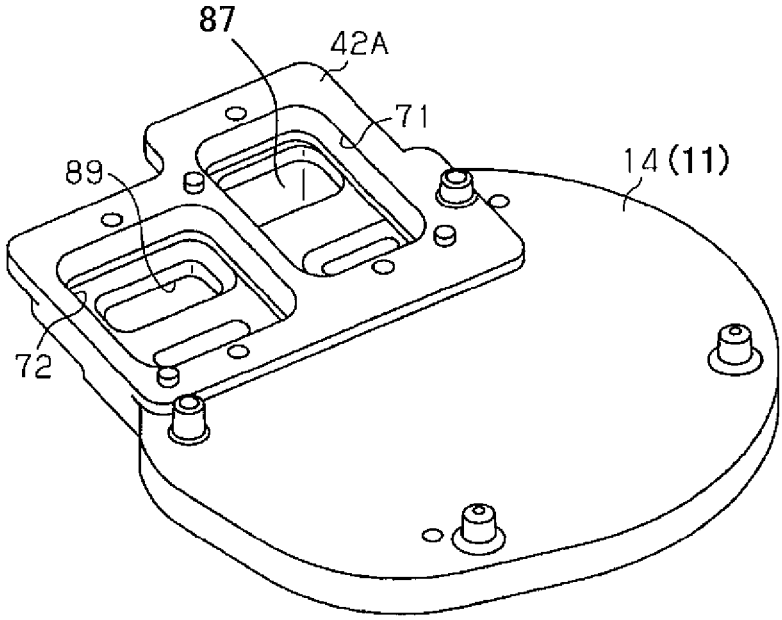
FIGS. 6 and 7 are perspective views showing the inverter housing and the connector, respectively, of still another embodiment.

Although in the first embodiment the single connector holder 42 is provided integrally with the inverter housing 14 on the outer peripheral surface thereof, plural connector holders may be provided on the inverter housing. Referring to FIG. 6, a first mounting hole 71 and a second mounting hole 72 are formed at one end of the housing 11 over the extension portion 42A and part of the end wall of the inverter housing 14. The length of the first mounting hole 71 as measured in radial direction of the inverter housing 14 is larger than that of the second mounting hole 72 as measured in the same way.

Figure 7:
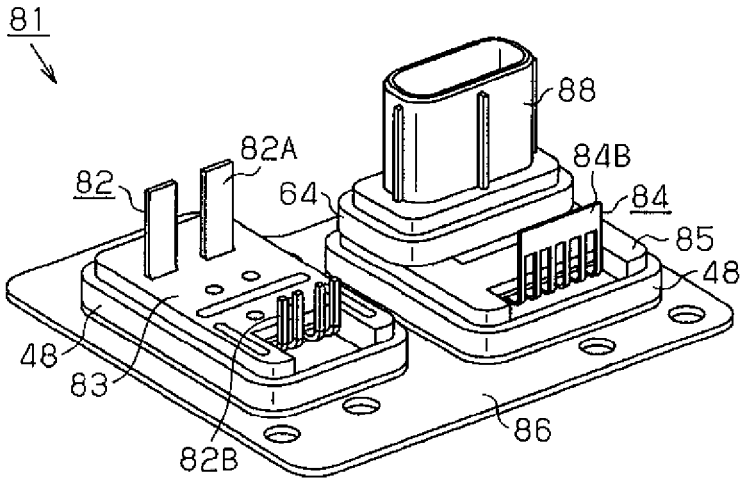

Referring to FIG. 7, the connector 81 has a first insulator 83 to be inserted into the first mounting hole 71 and a second insulator 85 to be inserted into the second mounting hole 72. The first insulator 83 holds a first bus bar 82 with one end 82A and the other end 82B thereof projected out from one end of the first insulator 83 toward the direction close to the electric motor 19 (see FIG. 1). Similarly, the second insulator 85 holds a second bus bar 84 with one end (not shown) and the other end 84B thereof projected out from one end of the second insulator 85 toward the direction close to the electric motor 19. The other ends of the first and second insulators 83 and 85 are secured to the cover 86 for closing the first and second mounting holes 71 and 72.

Figure 8:
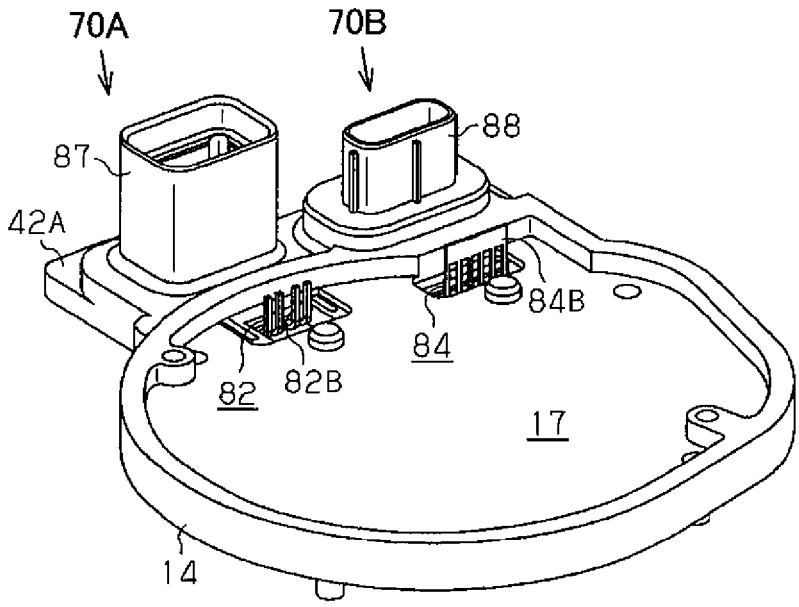
FIG. 8 is a perspective view showing the inverter housing and the connector of FIGS. 6 and 7 after assembly.

Referring to FIG. 8, the extension portion 42A is formed with a cylindrical portion 87 which extends in axial direction of the rotary shaft 23 toward the direction close to the electric motor 19. The interior of the cylindrical portion 87 communicates with the first mounting hole 71 (see FIG. 6). The cylindrical portion 87 is formed integrally with the inverter housing 14 and cooperates with the extension portion 42A to form a first connector holder 70A. As shown in FIG. 7, part of the second insulator 85 is formed in a cylindrical shape surrounding the one end of the second bus bar 84 to form a cylindrical portion 88. As shown in FIG. 6, the extension portion 42A is formed with a connector hole 89 which communicates with the second mounting hole 72 and through which the cylindrical portion 88 is inserted. The cylindrical portion 88 cooperates with the extension portion 42A to form a second connector holder 70B.

When the first insulator 83 is inserted into the first mounting hole 71 and the second insulator 85 formed with the cylindrical portion 88 is inserted into the second mounting hole 72, the one end 82A of the first bus bar 82 is positioned in the cylindrical portion 87 and the other end 82B of the first bus bar 82 is positioned in the accommodation space 17. The cylindrical portion 88 inserted through the connector hole 89 and surrounding the one end of the second bus bar 84 projects out from the extension portion 42A toward the direction close to the electric motor 19, and the other end 84B of the second bus bar 84 is positioned in the accommodation space 17.

In this way, two connector holders 70A and 70B may be provided on the outer periphery of the inverter housing 14. In the first connector holder 70A, the cylindrical portion 87 is formed integrally with the inverter housing 14. In the second connector holder 70B, the cylindrical portion 88 is formed separately from the inverter housing 14.

In the first and second embodiments electrical connection between the other end 52B of the bus bar 52 and the circuit board 31 by soldering is performed through the opening of the inverter housing 14 on the side of the electric motor 19 at a position adjacent to the connector holder 42. Alternatively, such connection may be performed at the central position of the circuit board 31. This prevents the inner peripheral surface of the inverter housing 14 from interfering with the connection between the other end 52B of the bus bar 52 and the circuit board 31 by soldering, which makes it easier to solder the connection from the side of the electric motor 19.

Although in the first embodiment the cylindrical portion 42B of the connector holder 42 extends in axial direction of rotary shaft 23, that is, parallel to the axis of the rotary shaft 23, the cylindrical portion 42B may extend in the direction intersecting the axis of the rotary shaft 23 as long as the cylindrical portion 42B extends toward the direction close to the electric motor 19.

Although in the first and second embodiments the cover 54 is provided on the end surface of the insulator 53, the cover 54 may be omitted. In such a case, the insulator 53 serves as the cover for closing the mounting hole 43.

In the first and second embodiments, the insulator 53 is integrated with the cover 54 in such a manner that the projection 53A of the insulator 53 is fitted in the recess 54A of the cover 54. Alternatively, the insulator 53 may be formed with a recess for receiving therein a projection formed on the cover 54.

In the first and second embodiments, the insulator 53 and the cover 54 are connected together by the projection 53A and the recess 54A fitted each other. Alternatively, the insulator 53 and the cover 54 may be connected by adhesive.

In the previous embodiments the circuit board 31 in the accommodation space 17 extends in radial direction of the rotary shaft 23, that is, the direction perpendicular to the axis of the rotary shaft 23. The circuit board 31 may extend not only in such direction but also in the direction intersecting the axis of the rotary shaft 23.

In the previous embodiments, the compression mechanism 18, the electric motor 19 and the inverter 30 are arranged in this order in axial direction of the rotary shaft 23 in the housing 11. Alternatively, the electric motor 19, the compression mechanism 18 and the inverter 30 may be arranged in this order in axial direction of the rotary shaft 23 in the housing 11.

Although in the previous embodiments the compression mechanism 18 is of a scroll type having the fixed and movable scrolls 20 and 21, it may be of a piston type or vane type.

The present invention is applicable to an air conditioner other than an automotive air conditioner.

The present invention is applicable not only to an air conditioner for a hybrid electric vehicle but also to an air conditioner for an electric vehicle or an engine powered vehicle.

What is claimed is:

1. a motor-driven compressor, comprising:

a housing having at one end thereof an accommodation space;

a rotary shaft extending in the housing;

a compression mechanism driven by the rotary shaft;

an electric motor rotating the rotary shaft;

a motor driver circuit provided in the accommodation space and having a circuit board;

a connector having a bus bar electrically connected to the circuit board; and a cylindrical portion located at the one end of the housing and located outside of the housing and having a longitudinal axis parallel to the rotary shaft and extending toward the direction close to the electric motor, the cylindrical portion being located outside of the accommodation space, wherein the compression mechanism, the electric motor and the motor driver circuit are arranged in the housing in axial direction of the rotary shaft, wherein the housing has a mounting hole communicating with the accommodation space and the interior of the cylindrical portion, the bus bar has a bent shape having opposite ends extended toward the direction close to the electric motor, the connector is disposed in the mounting hole with one end of the bus bar inserted in the cylindrical portion for electrical connection to an external device and the other end of the bus bar inserted in the accommodation space and electrically connected to the circuit board, and the mounting hole is closed up by a cover with a seal member provided therebetween.

2. The motor-driven compressor according to claim 1, wherein the connector has an insulator by which the bus bar is held, the insulator being integrated with the cover.

3. The motor-driven compressor according to claim 2, wherein one of the insulator and the cover has a recess and the other of the insulator and the cover has a projection fitted in the recess.

4. The motor-driven compressor according to claim 2, wherein the cylindrical portion is integrally formed with the insulator and inserted through a connector hole which is formed at the one end of the housing.

5. The motor-driven compressor according to claim 1, further comprising an extension portion extending outward from the periphery of the housing in radial direction of the rotary shaft, the cylindrical portion extending from the extension portion and surrounding the one end of the bus bar.

6. The motor-driven compressor according to claim 5, wherein the extension portion and the cylindrical portion are formed integrally with the housing.

7. The motor-driven compressor according to claim 5, wherein the mounting hole is formed in the extension portion which is formed over part of an end wall of the housing, and the mounting hole is opened on the end wall of the housing so as to insert the connector therein.

8. The motor-driven compressor according to claim 1, wherein the opposite ends of the bus bar extend parallel to each other toward the direction close to the electric motor.

9. The motor-driven compressor according to claim 1, wherein the cover and the housing are made of an electrically conductive material.

10. The motor-driven compressor according to claim 1, further comprising a through hole between the accommodation space and the mounting hole for inserting the other end of the bus bar, wherein the cross-sectional area of the through hole is smaller than the area of the circuit board.

* * * * *